US011725432B2

(12) United States Patent
Guerin et al.

(10) Patent No.: US 11,725,432 B2
(45) Date of Patent: Aug. 15, 2023

(54) MOTOR-DRIVEN CONTROL FOR A FLUSH DOOR HANDLE AND METHOD FOR OPERATING IT

(71) Applicants: U-Shin Italia S.p.A., Pianezza (IT); U-SHIN FRANCE, Creteil (FR)

(72) Inventors: Anthony Guerin, Pianezza (IT); Simone Ilardo, Pianezza (IT); Alberto Tropini, Pianezza (IT); Antonio Rocci, Pianezza (IT)

(73) Assignees: U-Shin Italia S.p.A., Pianezza (IT); U-SHIN FRANCE, Creteil (FR)

( * ) Notice: Subject to any disclaimer, the term of this patent is extended or adjusted under 35 U.S.C. 154(b) by 293 days.

(21) Appl. No.: 17/117,426

(22) Filed: Dec. 10, 2020

(65) Prior Publication Data

US 2021/0087862 A1 Mar. 25, 2021

Related U.S. Application Data

(63) Continuation of application No. PCT/EP2019/064548, filed on Jun. 4, 2019.

(30) Foreign Application Priority Data

Jun. 11, 2018 (EP) ..... 18176988

(51) Int. Cl.
*E05B 85/10* (2014.01)
*E05B 79/16* (2014.01)
(Continued)

(52) U.S. Cl.
CPC ..... *E05B 85/107* (2013.01); *E05B 79/16* (2013.01); *E05B 79/22* (2013.01); *E05B 81/06* (2013.01);
(Continued)

(58) Field of Classification Search
CPC ..... E05B 85/10; E05B 85/103; E05B 85/107; Y10S 292/31; Y10T 292/57
See application file for complete search history.

(56) References Cited

U.S. PATENT DOCUMENTS 3,993,338 A * 11/1976 Cherbourg ..... B60J 5/06 292/DIG. 31
5,080,409 A * 1/1992 Niswonger ..... E05F 15/668 292/345
(Continued)

FOREIGN PATENT DOCUMENTS

CN 108222714 A * 6/2018 ..... E05B 79/14
CN 108374615 A * 8/2018 ..... E05B 85/107
(Continued)

OTHER PUBLICATIONS

International Search Report for International Application PCT/EP2019/064548, dated Aug. 21, 2019.

*Primary Examiner* — Carlos Lugo
(74) *Attorney, Agent, or Firm* — Burris Law, PLLC

(57) ABSTRACT

A handle mechanism includes a handle and control mechanism. The handle is movable between a rest position flush with the door and a working position projecting therefrom. The control mechanism includes a first lever, a second lever, a tie-rod having ends linked to the first lever and the second lever according to hinged linkages at least one of which has a first oblong aperture parallel to the tie-rod, a device for elastically biasing the handle towards the rest position, a cam, a rod linking the cam to the tie-rod and including a pin. The tie-rod further includes a second oblong aperture parallel to the first oblong aperture and through which the pin of the rod extends in order to make the handle slide from the working position to the rest position in a motor-driven way through an over-travel of the cam when the elastic biasing device are not sufficient.

13 Claims, 5 Drawing Sheets

Figure 1:
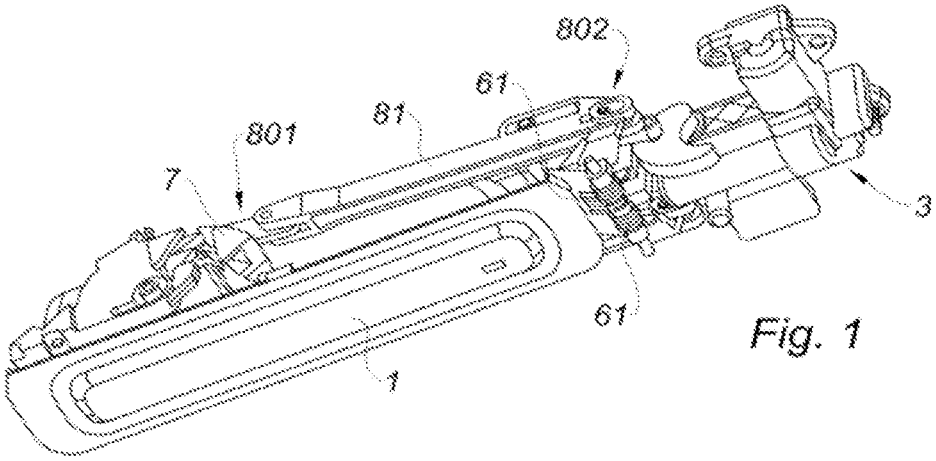

(51) Int. Cl.
*E05B 79/22* (2014.01)
*E05B 81/06* (2014.01)
*E05B 81/42* (2014.01)

(52) U.S. Cl.
CPC ..... *E05B 81/42* (2013.01); *E05B 85/103* (2013.01); *Y10S 292/31* (2013.01)

(56) References Cited

U.S. PATENT DOCUMENTS 5,123,687 A * 6/1992 Pfeiffer ..... E05B 1/0092 292/DIG. 31
5,558,372 A * 9/1996 Kapes ..... E05B 83/40 292/DIG. 31
7,441,812 B2 * 10/2008 Welsh ..... E05B 17/0025 292/DIG. 31
10,550,611 B2 * 2/2020 Och ..... E05B 85/107
11,214,994 B2 * 1/2022 Han ..... E05B 81/90
2016/0298366 A1 * 10/2016 Och ..... E05B 85/103
2018/0274271 A1 * 9/2018 Och ..... E05B 77/06
2020/0071973 A1 * 3/2020 Han ..... E05B 85/107

FOREIGN PATENT DOCUMENTS

CN 108843162 A * 11/2018 ..... E05B 79/22
DE 19808024 A1 * 9/1999 ..... E05B 1/00
DE 102016112689 1/2018
DE 102017210116 A1 * 12/2018
DE 102017010196 B3 * 4/2019 ..... E05B 81/06
EP 3106596 12/2016
EP 3396088 A1 * 10/2018 ..... E05B 77/06
EP 3404177 A1 * 11/2018 ..... E05B 17/042
FR 2742467 A1 * 6/1997 ..... E05B 85/10
WO 2011086144 7/2011

* cited by examiner

MOTOR-DRIVEN CONTROL FOR A FLUSH DOOR HANDLE AND METHOD FOR OPERATING IT

CROSS-REFERENCE TO RELATED APPLICATIONS

This application is a continuation of International Application No. PCT/EP2019/064548, filed on Jun. 4, 2019, which claims priority to and the benefit of EP 18176988.6, filed on Jun. 11, 2018. The disclosures of the above applications are incorporated herein by reference.

FIELD

The present disclosure relates to a control mechanism of a door handle, and more particularly of a door handle that is movable between a rest position in which the handle is flush with the door and a working position in which the handle projects with respect to the door.

BACKGROUND

The statements in this section merely provide background information related to the present disclosure and may not constitute prior art.

There are known, in particular in the automotive industry, doors equipped with flush handles that are deployable in a motor-driven way or a non-motor-driven way.

Furthermore, for the passage from the rest position to the working position, it is known to use either a pivoting control mechanism, or a translational control mechanism. Both of these mechanisms are typically used in modern handles.

A motor vehicle door handle with a pivoting control mechanism is known from the application EP 3106596 A, which concerns a handle for a vehicle door, including: an activation element configured to activate a lock of a vehicle door in order to clear the door, a gripping element configured to cooperate with the activation element so as to unlock the door, wherein the gripping element includes a gripping portion, the gripping element being movable between: a flush position in which the gripping portion is flush with an outer panel of the door, an active position in which the gripping portion projects with respect to the outer panel and becomes graspable, the gripping element cooperating with the activation element, and an opening position in which the handle drives the activation element to activate the lock and unlock the door, and finally a drive mechanism and an actuator lever cooperating with the gripping element so that the gripping element could be driven between the flush position and the active position, the handle being configured so that when the gripping element is pulled according to an opening direction, the gripping element drives the activation element which, in turn, activates the lock to unlock the door. This flush door handle mechanism is motor-driven essentially to make the handle move from the flush, and therefore the rest, position towards the active, and therefore the ready to be grasped, position. The reverse way for returning to the flush position after opening of the door is made using elastic means such as springs.

One drawback of such a door handle is that, in the event of a physical presence in the opening through which the handle extends to pass from the rest position to the active position, the elastic means are no longer enough to retract the latter towards its rest position flush with the door. One particular example being the presence of ice or frost.

Furthermore, a motor vehicle door handle with a translational control mechanism is known from the application WO 2011/086144 which concerns a retractable handle arrangement including a handle displaceable between stowed, deployed and operational states. This movement is controlled by a mechanism having first and second means each linked to a support structure and to the handle. At least one of these means is linked to the support structure through a hinge defining a pivot axis which is movable in response to the movement of the handle between the deployed state and the operational state. This movement of the pivot axis allows unlocking a door or another closure associated to the handle, for example via a crank acting on a Bowden cable.

Translational control mechanisms typically have the advantage of withstanding considerable loads, but also the drawback of being cumbersome. The one presented in this application is relatively compact but this is due to the absence of a motor-driven actuator. There are also known the applications DE102016112689 and US2016298366 relating to flush handles that are opened by a translational mechanism.

Hence, one major problem is that a human action is necessary for the deployment and retraction of the handle. Furthermore, in the event of a physical presence in the opening through which the handle extends to pass from the rest position to the active position, the elastic means may turn out to be no longer enough to retract the latter towards its rest position flush with the door. One example being the presence of ice or frost.

The door handle of the present disclosure addresses these and other concerns with typical flush door handles.

SUMMARY

This section provides a general summary of the disclosure and is not a comprehensive disclosure of its full scope or all of its features.

In order to address the above-mentioned problems, and especially: avoid an undesirable physical presence blocking the retraction of the handle after it has been used to unlock the latch, there is provided, in one form in accordance with the teachings of the present disclosure, a door handle movable between a rest position in which the handle is flush with the door and a working position in which the handle projects with respect to the door, the handle including a control mechanism including:

a first lever mounted so as to pivot about a first axis borne by the handle;

a second lever mounted so as to pivot about a second axis borne by the handle parallel to the first axis and away from the first axis according to a longitudinal direction of the handle;

at least one tie-rod having ends linked to the first lever and to the second lever according to hinged linkages at least one of which has a first oblong aperture parallel to the tie-rod;

means for elastically biasing the handle towards the rest position;

a cam adapted to rotate about its axis in order to make the handle translate between the rest and working positions using a motor-driven actuator;

a rod linking the cam to the tie-rod and including a pin extending perpendicularly with respect to the plane of the rod;

the first lever, the second lever, the tie-rod and the handle forming a deformable assembly whose deformation causes a translational displacement of the handle, the tie-rod further including a second oblong aperture parallel to the first oblong aperture and through which the pin of the rod extends in order to make the handle slide from the working position to the rest position in a motor-driven way by an over-travel of the cam when the elastic biasing means are not enough.

In one variation, the door handle according to the teachings of the present disclosure is such that all of the axis of rotation of the first lever, the axis of rotation of the second lever and the axis of rotation of the cam are parallel to one another. This allows for a gain in compactness while enabling an extension of the volume occupied by the handle over the length rather than the width of the door, thereby reducing bulk.

For a greater stability during the extraction movement of the handle from the rest position towards the working position, the door handle according to one form of the teachings of the present disclosure is such that it includes two tie-rods disposed on either side of a midplane extending according to a longitudinal direction of the handle and each having ends linked to the first lever and to the second lever according to hinged linkages at least one of the ends has:

a first oblong aperture parallel to the tie-rod a second oblong aperture parallel to the first oblong aperture.

In one variation, the door handle according to the teachings of the present disclosure is such that the second oblong aperture parallel to the first oblong aperture and through which the pin of the rod extends, has a length larger than that of the first oblong aperture. Indeed, the two oblong apertures have different functions: the first aperture serves the unlock function of the latch known per se and which is achieved through a rotation subsequent to a force exerted by a user wishing to open his/her door once the working position is reached (pull on a Bowden cable), the second aperture serves the door handle because the travel of the cam allows adopting different positions and the pin of the rod shall be able to move in the aperture while the cam occupies its different angular positions. Thus, the travel required for unlocking corresponding to the first oblong aperture is preferably short to facilitate unlocking whereas the travel and the motor-driven retraction over-travel is, in one form, longer because the handle shall be deployed enough to facilitate grasping.

In one variation, the door handle according to the teachings of the present disclosure is such that the cam has a lateral contact surface bearing on the second lever so as to make it rotate about its axis in order to make the handle slide. This permanent contact for creating the translational movement generates less noise than a drive by means of a fitted pin. This is a permanent function serving for the deployment of the handle each time it is used to open the door.

Furthermore, in one form, the cam has a planar surface from which emerges, according to a direction perpendicular to the surface, a fastening pin adapted to receive the rod by fitting. This allows pulling on the tie-rod in the event of an over-travel in a motor-driven way while reducing the likelihood of break-up of the mechanism.

For a greater compactness, the cam of the handle according to the teachings of the present disclosure can be directly mounted on an output axis of an electric motor belonging to the actuator.

In one variation, the door handle according to the teachings of the present disclosure is such that the deformable assembly whose deformation causes a translational displacement of the handle is configured so that the displacement is reversible by the effect of the biasing means and/or by the effect of the motor-driven actuator. This reversibility allows using the elastic means by default and the motor-driven return in the event of a blockage by a physical presence such as ice or frost.

In one variation, the means for elastically biasing the handle towards the rest position include at least one torsion spring fastened on the axis of rotation of the second lever and bearing on a fixed support of the handle so as to exert a biasing force on the lever towards its rest angular position.

In order to a have a second energy supply and for a greater robustness, the means for elastically biasing the handle towards the rest position can also include a dual torsion spring fastened on the axis of rotation of the first lever and bearing on a fixed support of the handle so as to exert a second biasing force on the first lever towards its rest angular position.

In one variation, the teachings of the present disclosure cover a motor vehicle door including a door handle according to the teachings of the present disclosure fastened to the door.

The present disclosure also concerns a method for displacing a door handle provided with the mechanism according to the teachings of the present disclosure and including, in one form, the following successive steps:

starting from the rest position of the handle, the cam rotates in a first direction from the rest angular position towards the working angular position in order to cause the rotation of the second lever and the translational displacement of the handle towards its working position, starting from the working position of the handle, the cam returns in a second direction opposite to the first one back in the rest angular position and the deformable assembly is subjected to a biasing force exerted by the means for elastically biasing the handle towards its rest position, if the force exerted by the elastic biasing means is not enough to bias the handle towards its rest position, then the actuator performs an over-travel of the motor-driven rotation of the cam in the second direction opposite to the first one in order to bring the handle back by pulling on the tie-rod through the pin of the rod.

In one variation, the method according to the present disclosure is such that the handle control mechanism is fastened to a motor vehicle door and the actuator causing the motor-driven rotation of the cam performs the over-travel only when the motor vehicle is moving. Many advantages are obtained if this method is operated when the vehicle is moving.

Indeed, first of all, this allows avoiding the motor-driven retraction occurring while a user still has his/her fingers in the opening of the handle and having them trapped by the actuator and therefore with a force that is greater than that of the elastic means.

Second, once the vehicle has started moving, the generated noise will be less perceivable by the user.

Third, an electronic control of the kinematics to block it in the over-travel angular position would allow preventing the handle from coming out by inertial effect. Hence, an additional means for avoiding the door being opened in the event of an accident is obtained.

Further areas of applicability will become apparent from the description provided herein. It should be understood that the description and specific examples are intended for purposes of illustration only and are not intended to limit the scope of the present disclosure.

DRAWINGS

Figure 2A:
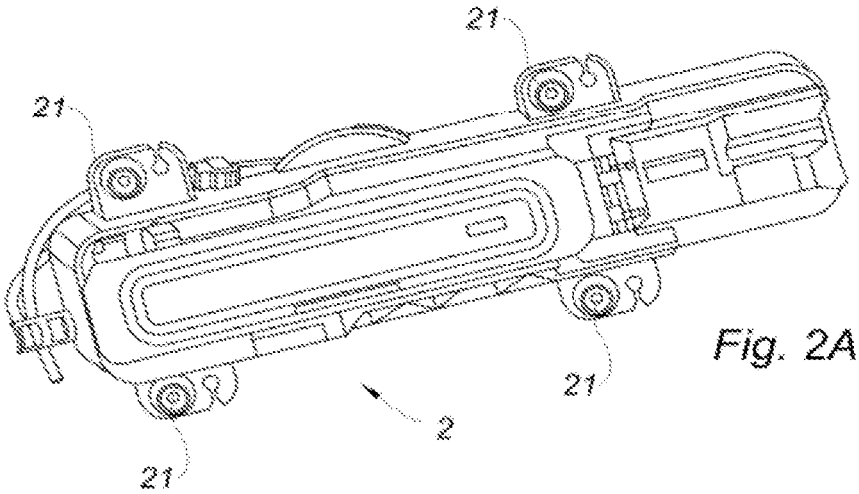
Figure 2B:
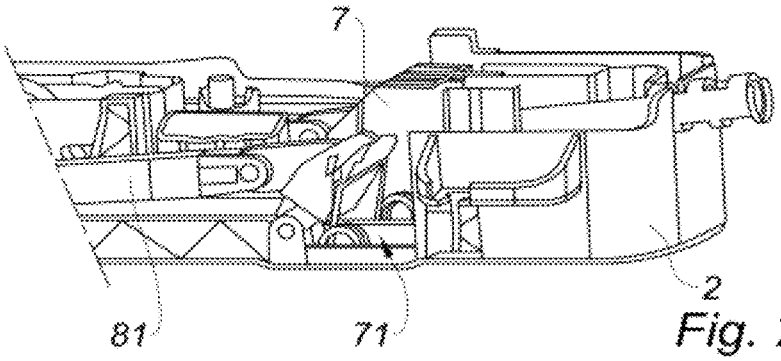
Figure 3:
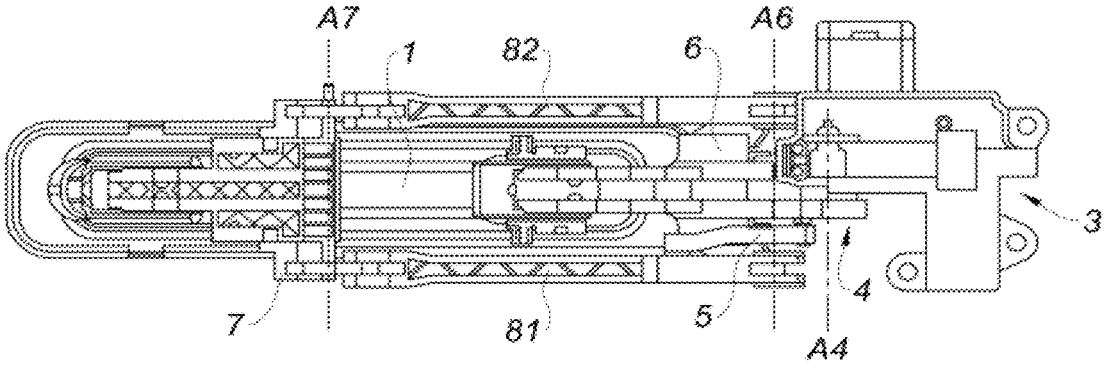
Figure 4:
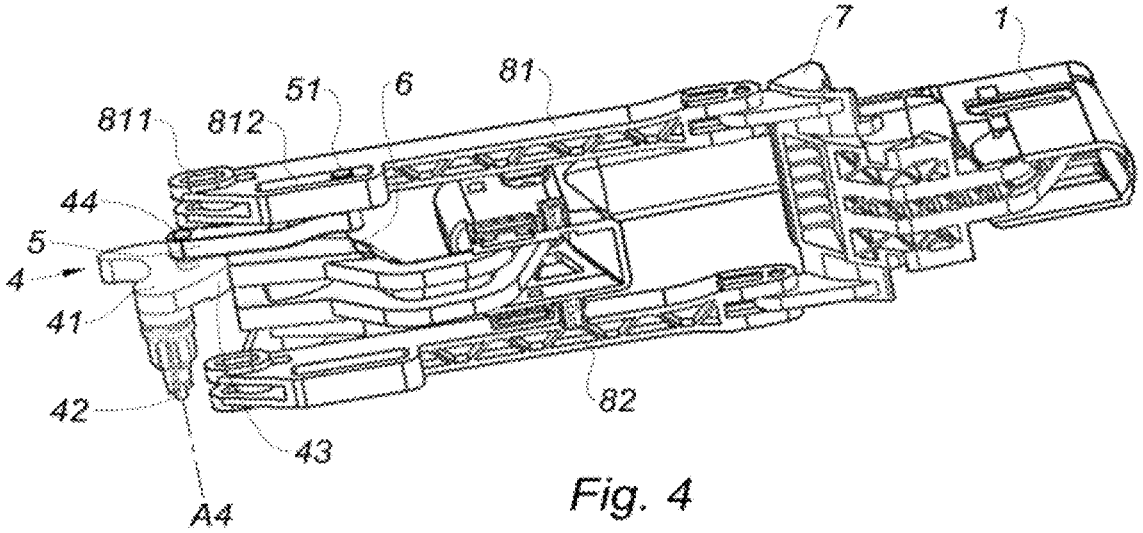
Figure 5A:
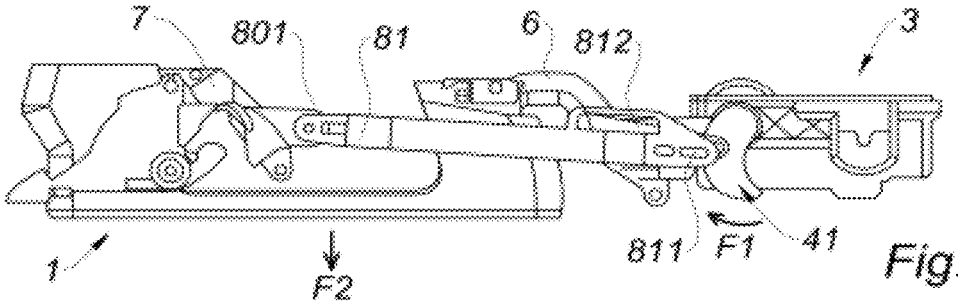
Figure 5B:
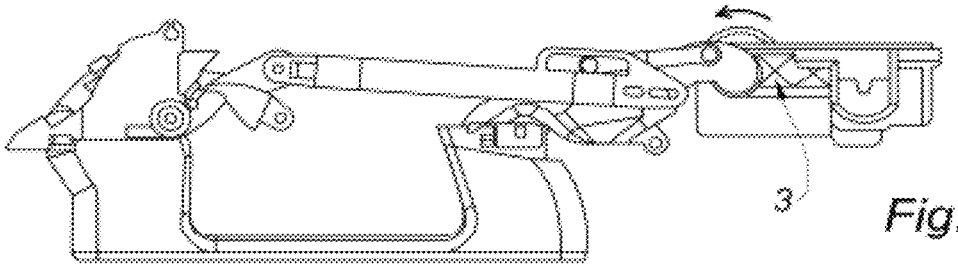
Figure 5C:
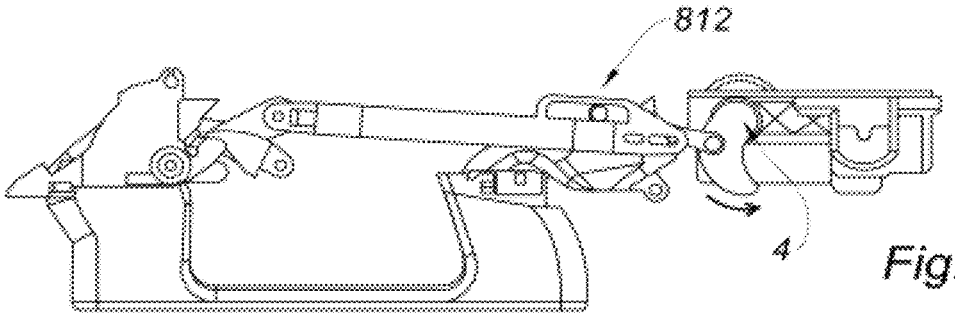
Figure 5D:
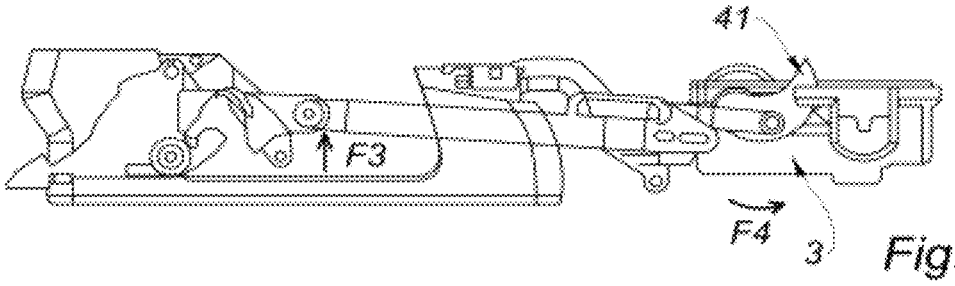
Figure 6:
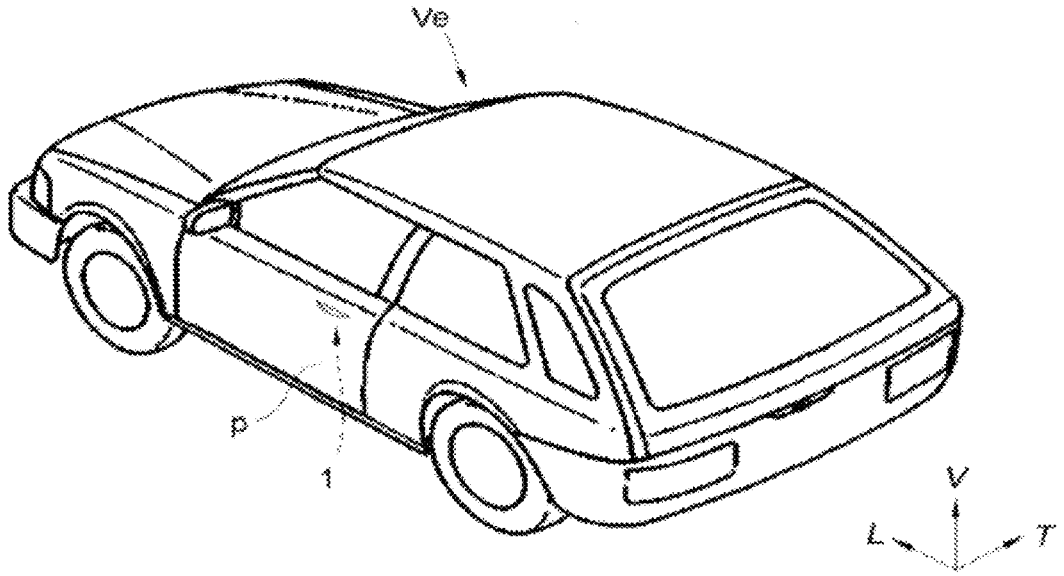

In order that the disclosure may be well understood, there will now be described various forms thereof, given by way of example, reference being made to the accompanying drawings, in which:

FIG. 1 is a perspective view of a door handle according to the teachings of the present disclosure, FIG. 2A is another perspective view of the handle of FIG. 1, illustrated on its support intended to be fastened to a motor vehicle door in accordance with the teachings of the present disclosure, FIG. 2B is an enlarged perspective view of a portion of the handle of FIG. 1, illustrating a first lever and its elastic biasing means of the handle, FIG. 3 is a back view of the door handle of FIG. 1, FIG. 4 is a perspective view of a deformable assembly of a control mechanism of the door handle of FIG. 1 in accordance with the teachings of the present disclosure, FIGS. 5A to 5D are top views of the handle of FIG. 1, illustrating different steps of a method according to the teachings of the present disclosure for when the handle is blocked in the working position, and FIG. 6 is a perspective view of an example vehicle with a handle according to the teachings of the present disclosure fastened on a door.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIGS. 1-6 generally, a door handle mechanism including a handle 1 of a door and a control mechanism is illustrated. The handle 1 is movable between a rest position in which the handle is flush with the door, and a working position in which the handle projects with respect to the door.

The control mechanism includes a case or support 2 equipped with bosses 21 for fastening to the door (FIG. 2A). The handle 1 is mounted so as to slide within an opening of the door.

The handle 1 according to one example is illustrated in FIG. 1.

The displacement mechanism of the handle includes a first lever 7 linked by a first hinged linkage 801 to a tie-rod 81 and hingedly mounted on an axis A7 (FIG. 3) borne by the handle.

More specifically, and for a greater stability, the first lever 7 is linked to two tie-rods 81 and 82 symmetrical with respect to a midplane extending according to a longitudinal direction of the handle, and having at the end opposite to the first hinged linkage 801, a second lever 6 to which the tie-rods 81 and 82 are linked by means of a hinge including an axis of rotation A6 (FIG. 3) borne by the second lever 6 and fitted into an oblong aperture 811 of the second hinged linkage 802 formed in each of the tie-rods 81 and 82 and extending parallel to the tie-rods.

Thus, the oblong aperture 811 confers a clearance on each tie-rod 81, 82 according to a longitudinal direction of the tie-rod. One single clearance in one tie-rod is necessary for the handle mechanism as illustrated for example by FIGS. 3 and 4.

Still in FIG. 1, in the door handle control mechanism, there is an actuator 3 for displacing the levers 6 and 7 and the tie-rods 81 and 82 thanks to a cam 4 (FIGS. 3 & 4) bearing directly on the second lever 6.

Indeed, the first lever 7 serves as a support for the stability of the translational extension of the handle 1 whereas the second lever 6 is the lever bearing directly on the cam 4.

Two torsion springs 61 disposed along the axis A6 are shown in FIG. 1 and serve to bias the door handle from the working position towards the rest position once the handle has been used to unlock the latch and open the door.

In FIG. 2A, there are illustrated the case or support 2 as well as the fastening bosses 21 for fastening the set constituted by the handle and its support on a motor vehicle door.

Referring to FIG. 2B, there is highlighted the dual torsion spring 71 serving as a means for elastically biasing the lever 7 from the working position towards the rest position once the handle has been used to unlock the latch and open the door.

FIG. 3 shows the axes of rotation A7 of the first lever 7, A6 of the second lever 6 and A4 of the cam 4 which are parallel to one another so as to obtain the translational deployment and at the same time improve the compactness of the mechanism of the handle according to the teachings of the present disclosure.

The device according to the teachings of the present disclosure advantageously extends in a plane parallel to the ground lengthwise rather than in a plane perpendicular to the ground where it would be more cumbersome and likely to occupy a space intended for another function within the door (p) of a vehicle (Ve).

In the same FIG. 3, there is shown a rod 5 linking the cam 4 to the tie-rod 81 and including a pin 51 also shown in FIG. 4 and extending perpendicularly with respect to the plane of the rod 5.

In FIG. 4, there is shown the first lever 7, the second lever 6 and the tie-rods 81, 82 forming a deformable assembly whose deformation causes a translational displacement of the handle 1.

The movement is actuated by the cam 4 having a planar surface 41 and a lateral contact surface 43. A fastening pin 44 adapted to receive the rod 5 by fitting emerges from the planar surface 41, according to a direction perpendicular to the latter.

The other side of the rod 5 has a pin 51 which extends parallel to the fastening pin 44 and through the second oblong aperture 812 belonging to the tie-rod 81.

The cam 4 is mounted on an axis A4 borne by a motor with an output shaft 42, the motor being fastened in the actuator 3. The actuator is connected to a controller adapted to receive control signals for deploying or retracting the handle.

The operating mode of the door handle control mechanism according to the teachings of the present disclosure will now be explained using FIGS. 5A-5D and 6.

In order to bring the handle 1 towards the working position, a deployment control signal is sent to the motor-driven actuator 3 by a controller (not represented).

In FIG. 5A, there is shown the rest angular position of the deployment member which is the cam 4. This is driven in rotation in the clockwise direction as illustrated by the arrow F1 in FIG. 5A so that the first and second levers 7 and 6 respectively are displaced by the travel of the cam in order to move the handle 1 in translation towards the working position (i.e., arrow F2 in FIG. 5A).

For indication, it is specified that, simultaneously with the above-described process, an unlocking signal is sent to an electric unlocking member associated to a latch belonging to the door p of the vehicle Ve.

Starting from this working position, a pull performed on the handle 1 in the same direction as that indicated by the arrow F2 then generates a rotation of the handle pulling on a Bowden cable for example to open the door in a manner known per se (not represented). Indeed, the Bowden cable is linked to a latch belonging to the door.

Once the working position is reached (FIG. 5B), the handle is adapted to be grasped by a user to pull thereupon and cause opening of the door p.

In the normal condition, i.e., in the absence of any physical presence in the opening of the handle, the motor subsequently brings the cam 4 towards its initial rest angular position, within a predetermined time period, at the same time as the torsion springs 61 and the dual torsion spring 71 act respectively on the first and second levers 7 and 6 to bring the handle back.

In this instance, the rotation of the cam 4 is done in the counterclockwise direction. In this kinematic chain, the cam 4 always remains in contact with the second lever 6 by its lateral surface 43 (FIG. 4).

FIG. 5C, the situation of the presence of a blocking element such as ice or frost (not represented) preventing the return of the handle 1 towards its rest position is illustrated. In this instance, the rotation of the cam 4 is done in the counterclockwise direction but the second lever 6 has lost contact with the cam 4. It is shown that the pin 51 of the rod 5 is displaced into the second oblong aperture 812 towards the cam as it is driven by the counterclockwise rotation of the latter.

Afterwards, in FIG. 5D, the controller having detected that the handle 1 has not been retracted, may give an over-travel instruction to the actuator 3 so that the latter resumes the anticlockwise rotation of the cam 4. The detection may be done in any way, mention may be made for example to a position sensor type detection means.

This over-travel brings the pin 51 of the rod 5 towards the stop close to the cam 4 belonging to the tie-rod 81 in order to pull on the tie-rod 81 in a motor-driven way and force the handle 1 to come in through the first and second levers respectively 7 and 6.

The direction of retraction towards the rest position is indicated by the arrow F3 and the over-stroke one by the arrow F4.

The instruction of motor-driven retraction towards the rest position as described hereinabove can be given when the vehicle is moving. Thus, it is ensured that the perceived noise is reduced and that there is no user's hand likely to be trapped during the retraction. Finally, this would also avoid an undesired opening in the event of impact for example if the over-travel angular position of FIG. 5D was held.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A door handle mechanism for a door, the door handle mechanism comprising:

a handle movable between a rest position in which the handle is flush with the door and a working position in which the handle projects with respect to the door; and a control mechanism comprising:

a first lever mounted so as to pivot about a first axis borne by the handle;

a second lever mounted so as to pivot about a second axis borne by the handle parallel to the first axis and away from the first axis according to a longitudinal direction of the handle;

a first tie-rod having ends respectively linked to the first lever and to the second lever according to respective hinged connections at least one of which has a first oblong aperture parallel to a longitudinal extension of the first tie-rod;

a means for elastically biasing the handle towards the rest position;

a cam adapted to rotate about a cam axis in order to translate the handle between the rest position and the working position using a motor-driven actuator; and a rod linking the cam to the first tie-rod and including a pin extending perpendicularly with respect to a plane of the rod;

wherein the first lever, the second lever, the first tie-rod and the handle form a movable assembly whose movement causes a translational displacement of the handle, wherein the first tie-rod further comprises a second oblong aperture parallel to the first oblong aperture and through which the pin of the rod extends in order to make the handle slide from the working position to the rest position in a motor-driven way by an over-travel of the cam when the means for elastically biasing the handle are not enough.

2. The door handle mechanism according to claim 1, wherein the first axis, the second axis, and the cam axis are parallel to one another.

3. The door handle mechanism according to claim 1, further comprising a second tie-rod, wherein the first and second tie-rods are disposed on either side of a midplane extending according to a longitudinal direction of the handle and the second tie-rod has ends respectively linked to the first lever and to the second lever according to respective hinged connections at least one of which has a first oblong aperture parallel to the second tie-rod and a second oblong aperture parallel to the first oblong aperture parallel to the second tie-rod, wherein the first lever, the second lever, the first tie-rod, the second tie-rod, and the handle form the deformable assembly whose deformation causes a translational displacement of the handle.

4. The door handle mechanism according to claim 1, wherein the second oblong aperture parallel to the first oblong aperture and through which the pin of the rod extends, has a length larger than that of the first oblong aperture.

5. The door handle mechanism according to claim 1, wherein the cam has a lateral contact surface bearing on the second lever so as to make it rotate about the cam axis in order to make the handle slide.

6. The door handle mechanism according to claim 1, wherein the cam has a planar surface from which emerges, according to a direction perpendicular to the surface, a fastening pin adapted to receive the rod by fitting.

7. The door handle mechanism according to claim 1, wherein the cam is directly mounted on an output axis of an electric motor belonging to the actuator.

8. The door handle mechanism according to claim 1, wherein the deformable assembly whose deformation causes a translational displacement of the handle is configured so that the displacement is reversible by the effect of the biasing means, by the effect of the motor-driven actuator, or by the effect of the biasing means and the motor-driven actuator.

9. The door handle mechanism according to claim 1, wherein the means for elastically biasing the handle towards the rest position comprise at least one torsion spring fastened on the second axis and bearing on a fixed support of the handle so as to exert a biasing force on the lever towards its rest position.

10. The door handle mechanism according to claim 1, wherein the means for elastically biasing the handle towards the rest position comprise a dual torsion spring fastened on the first axis and bearing on a fixed support of the handle so as to exert a biasing force on the lever towards its rest position.

11. A motor vehicle door comprising the door handle mechanism according to claim 1, wherein the door handle mechanism is fastened to the motor vehicle door.

12. A method for displacing the handle of the door handle mechanism according to claim 1, the method comprising the following successive steps:

rotating the cam in a first direction from the rest position towards the working position in order to cause the rotation of the second lever and the translational displacement of the handle towards the working position;

rotating the cam in a second direction opposite to the first direction from the working position back to the rest position and subjecting the deformable assembly to a biasing force exerted by the means for elastically biasing the handle towards the rest position;

performing, via the actuator, an over-travel of motor-driven rotation of the cam in the second direction in order to bring the handle back to the rest position by pulling on the first tie-rod through the pin of the rod in response to the biasing force not being sufficient to move the handle to the rest position.

13. The method for displacing the handle according to claim 12, wherein the control mechanism is fastened to a motor vehicle door and the actuator causing the motor-driven rotation of the cam performs the over-travel only when the motor vehicle is moving.

* * * * *